US005669806A

United States Patent [19]

Samples, Jr.

[11] Patent Number: 5,669,806

[45] Date of Patent: Sep. 23, 1997

[54] IMPACT SHIELDING DEVICE FOR SHOT BLASTING CHAMBERS

[76] Inventor: Robert H. Samples, Jr., 12846 Crest Ridge Dr., Jacksonville, Fla. 32258

[21] Appl. No.: 645,796

[22] Filed: May 16, 1996

[51] Int. Cl.[6] ..... B24C 9/00

[52] U.S. Cl. ..... 451/89; 451/453; 451/451

[58] Field of Search ..... 451/89, 451, 453, 451/454, 455, 457; 72/53; 29/DIG. 36

[56] References Cited

U.S. PATENT DOCUMENTS

| | | | |
|---|---|---|---|
| 1,047,571 | 12/1912 | Sadler | 451/455 |
| 2,304,071 | 12/1942 | Bollinger | 451/451 |
| 2,423,287 | 7/1947 | Beisel | 451/451 |
| 2,442,678 | 6/1948 | Dybiec | 451/451 |
| 2,751,729 | 6/1956 | Christiansen | 451/453 |
| 3,242,616 | 3/1966 | Haider | 451/89 |
| 3,460,294 | 8/1969 | Stumpf | 451/453 |
| 3,705,511 | 12/1972 | Brandel et al. | 72/53 |
| 4,325,292 | 4/1982 | McNinney, Jr. et al. | 451/453 |
| 4,426,866 | 1/1984 | Klass | 72/53 |

*Primary Examiner*—James G. Smith
*Assistant Examiner*—Dona C. Edwards
*Attorney, Agent, or Firm*—Thomas C. Saitta

[57] ABSTRACT

A shielding device for shot blasting or shot peening chambers comprising a shot retention chamber, preferably with multiple interior compartments formed by divider walls, which retains a protective layer of shot to absorb the high energy impact of high velocity shot particles, the shot layer being retained by magnetic or electrically enhanced magnetic means such that the shot retention chamber can be mounted at any angle up to 90 degrees above or below horizontal.

14 Claims, 8 Drawing Sheets

IMPACT SHIELDING DEVICE FOR SHOT BLASTING CHAMBERS

BACKGROUND OF THE INVENTION

This invention relates in general to devices used to shield surfaces or components in shot blasting and shot peening chambers to prevent unwanted degradation or destruction of these surfaces or components. More particularly, the invention relates to a device which utilizes magnetism or a combination of magnetism and electrical current to retain a layer of shot particles at a specific location to absorb the impact of high velocity shot particles and prevent the high velocity shot particles from damaging the surface or component shielded by the device.

Shot blasting and shot peening are well known techniques for treating workpieces, either to clean or remove material from the surface under the former or to shape, form or alter the material or mechanical properties of the surface of a material under the latter. Particles called shot are directed at a high velocity against the workpiece to effect the desired result. Some devices are mobile and travel relative to the surface being treated, while others consist of fixed housings, called blast chambers, with the workpiece positioned in a stationary manner within the blast chamber or, in the case of a longitudinally extended workpiece such as cable, wire or the like, the workpiece is pulled through the housing in a continuous or incremental manner. The shot, which consists of material particularly suited to the operation being performed, such as walnut shells, aluminum pellets, brass pellets, copper pellets, iron pellets, or extremely hard steel pellets, is thrown or impelled against the workpiece by shot delivery mechanisms, typically using centrifugal force, air pressure or magnetic propulsion. A centrifugal force apparatus typically utilizes a rotating paddle wheel type impeller which can throw pellets at 100 to 300 ft/sec, the paddle wheel rotating from 1500 to 3600 rpm, with 4 to 12 paddles on a wheel. For cleaning wire, a typical apparatus may throw a ½ ounce bunch or packet of loose steel shot once every 1 to 3 milliseconds. In many instances a good portion of the shot is thrown past the workpiece or only slightly glances off the material, especially where thin wires or cables are being cleaned, such that a significant amount of the high velocity shot is driven directly against the opposing wall of the blast chamber with little or no loss of velocity. Over time, the effect of this errant shot is the same as if the wall itself was being treated—the shot erodes the chamber wall at the point of contact, which requires repair or replacement of housing components on a periodic basis.

In many applications multiple shot delivery mechanisms are employed in a single blast chamber so that the workpiece can be treated from various angles. In wire cleaning, for example, typical blast chambers may have from two to six shot delivery wheels, the wheels being linearly separated so that they do not impel shot at each other. In an apparatus with three such wheels, one is typically positioned at the top of the unit to throw shot vertically downward, with the other two wheels being positioned on opposite sides at 120 degrees from the top wheel and aimed at 30 degrees above the horizontal. It is known to protect against the effects of the errant shot from the top wheel in an inexpensive manner by providing a trough on the bottom of the blast chamber, the trough being filled with shot to a sufficient depth to absorb the force of impact from the high velocity shot and thus protect the bottom wall of the blast chamber. To protect the other surfaces, wear plates of high strength chrome molybdenum steel or the like are installed on the chamber walls at the areas of high impact, but in high velocity chambers using hard shot even these wear plates have to be replaced every 200 to 400 work hours.

It is an object of this invention to provide a means to protect the wall surfaces or other components within a shot blasting chamber from high velocity shot particles which are composed of magnetic or electrically conductive material in such manner that negates the need to provide and replace wear plates. It is a further object to provide such a means which protects the surfaces by absorbing the impact force of the high velocity shot particles in a bed of shot particles retained in proper position even on angled or vertical walls. It is a further object to maintain the impact absorbing bed of shot particles in place by magnetic attraction, either by magnetic force alone for ferro-magnetic shot particles or by electrically enhanced magnetic force for electrically conducting shot particles. It is a further object to provide various embodiments for the shot retention chamber in order to maximize the effectiveness of the device in various circumstances by providing alternative constructions for side and interior divider walls.

SUMMARY OF THE INVENTION

The invention is a device for shielding the interior surfaces or components of shot blasting or peening chambers from the destructive effects of high velocity shot particles which bypass the intended workpiece target or are deflected with little loss of velocity before striking the chamber surface. The device in general comprises a shot retention chamber having an open front which is adapted to be mounted within the blast chamber such that the open front faces a shot impeller device, the shot retention chamber having side walls, end walls and a back wall, and preferably being divided by interior divider walls into multiple compartments. An impact absorbing layer or bed of shot particles is maintained within the shot retention chamber to absorb and negate the force of the high velocity shot particles which bypass the workpiece. The layer of shot particles is retained within the shot retention chamber magnetically, or by a combination of magnets and electrical current, such that the shot retention chamber may be mounted within the blasting chamber with the open front facing in any angular direction. The magnetic entrapment of the shot particle layer enables the chamber to be angled the entire range from 0 to 90 degrees above or below the horizontal, meaning that the open front can even face downward. For example, in a blast chamber where a side shot impeller is directed at an angle 30 degrees above the horizontal, the shot retention chamber aligned with this impeller will be positioned to face 30 degrees below the horizontal.

Preferably the shot retention chamber comprises multiple compartments, each compartment having its own magnet positioned behind the back wall. The side walls are composed of non-magnetic material, while the end walls and divider walls are composed of ferromagnetic material. The back wall is relatively thin and is also composed of a non-magnetic material. The shot blasting chamber and individual compartments may be designed in various configurations, including an embodiment where all elements are rectilinear, or the back wall my be angled or curved, or the individual compartments may be angled, v-shaped or curved as well. In the embodiment for use with non-ferromagnetic but electrically conductive shot particles, the device will further incorporate means to pass electrical current through the shot layer between two electrodes, positioned such that the electrical current flows at an angle, preferably 90 degrees, to the magnetic field. For example, the side walls of the device may comprise the opposing electrodes with the end walls and dividers being either composed of an insulating material or electrically insulated from the side wall electrodes.

The configuration of the shot retention chamber, the strength of the magnets and electrical current, and the positioning of chamber relative to the shot impeller mechanism are all dependent on operational parameters particular to the shot blasting chamber being utilized. In all circumstances, the shielding device must provide and maintain a layer of shot particles sufficient to absorb all the force and energy from the high velocity shot particles such that the back wall of the chamber is not degraded and preferably such that the retained shot layer is self-regenerating, whereby any shot particles ejected from the chamber are replaced by retaining some of the high velocity shot particles.

DETAILED DESCRIPTION OF THE INVENTION

The invention will now be described with regard to the best mode and preferred embodiment, with reference to the figures and enumerated components. In very general terms, the invention comprises a shot retention chamber adapted for use with shot blasting or peening devices having shot blasting or peening chambers or housings with surfaces or components susceptible to damage from errant high velocity shot particles, the shot retention chamber utilizing magnetic or electrically enhanced magnetic means to retain a protective bed or layer of shot particles within one or more compartments of the chamber, the shot layer acting to absorb and negate the energy of the high velocity shot particles to prevent them from damaging surfaces of the shot blasting or peening chamber.

Figure 1:
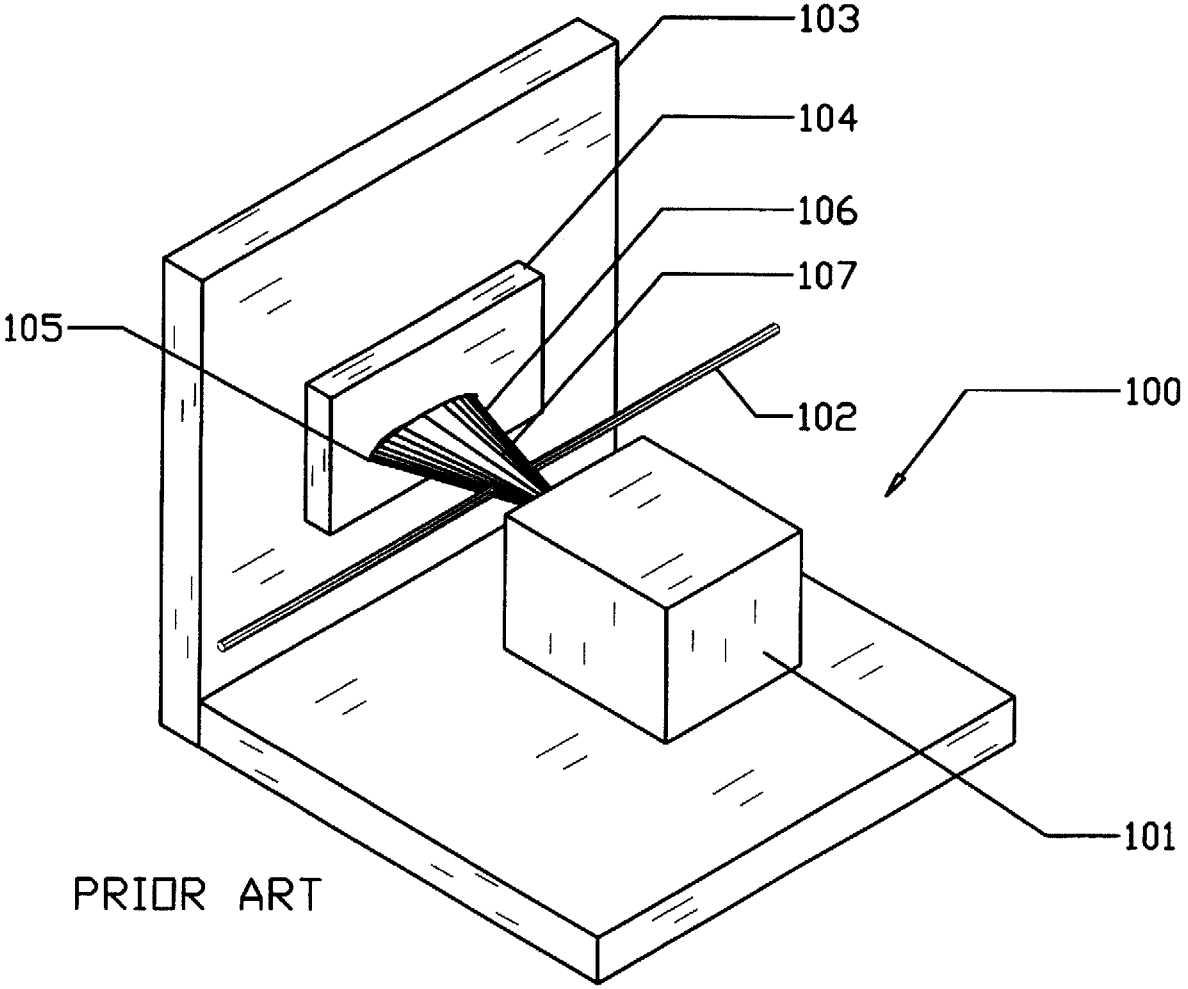
PRIOR ART FIGURE 1
FIG. 1 is an illustration of the prior art, showing a wear plate attached to the wall of a blast chamber and illustrating a wear pattern commonly observed in a centrifugal force apparatus.

FIG. 1 is an illustration of the current state of the art, showing a partially exposed view of a typical shot blasting system or chamber 100. The term shot blasting system or chamber 100 shall be taken herein to include apparatus and techniques known both as shot blasting and shot peening. Shot blasting is used to remove, abrade or otherwise clean articles, while shot peening is used to shape, form or alter the material or mechanical properties of the surface of articles in a particular manner. A shot particle impeller means 101 throws shot particles 107 in a shot particle stream 106 against a workpiece 102. In the illustration shown, the workpiece 102 is a cable or wire which can be continually or incrementally drawn or fed through the shot blasting chamber 100 for treatment, such as for removal of coatings, paint or rust. The shot impeller means 101 may comprise any means capable of delivering quantities of shot particles 107 at the workpiece 102 with sufficient force and in sufficient number to accomplish the desired abrasion or forming task. The shot particles 107 may comprise any of many known materials used in this process, such as small particles or pellets of metal which are either ferromagnetic or electrically conductive. Typical shot impellers 101 use centrifugal force, air pressure or magnetic propulsion to deliver the shot particles 107 against the workpiece 102. A typical centrifugal force shot impeller means 101 comprises a rotating paddle wheel having a number of separate compartments which receive the shot 107 and then direct the shot 107 at high velocity against the workpiece 102 in discrete packets or bundles, creating a shot stream 106 having a radial spread. In order that sufficient shot 107 strike the entire exposed surface of the workpiece 102, it is necessary to provide a shot stream 106 which is slightly wider than the workpiece 102. This means that a relatively large number of shot particles 107 will miss the workpiece 102 entirely, and also some will have only minimal contact with the workpiece 102, such that a large number of shot 107 will travel at high velocity past the workpiece 102 to strike any barrier object in their path, the barrier being the shot blasting chamber wall 103. To prevent destruction of the chamber wall 103, wear plates 104 composed of high strength materials, such as specially treated chrome molybdenum steel, resistant to the degradative effects of the high velocity shot 107, are attached to the chamber walls 103 at the impact area 105. Over successive time periods, which can be as short as 200 to 400 work hours, these wear plates 104 must be replaced as they are worn away by the errant shot 107.

Figure 2:
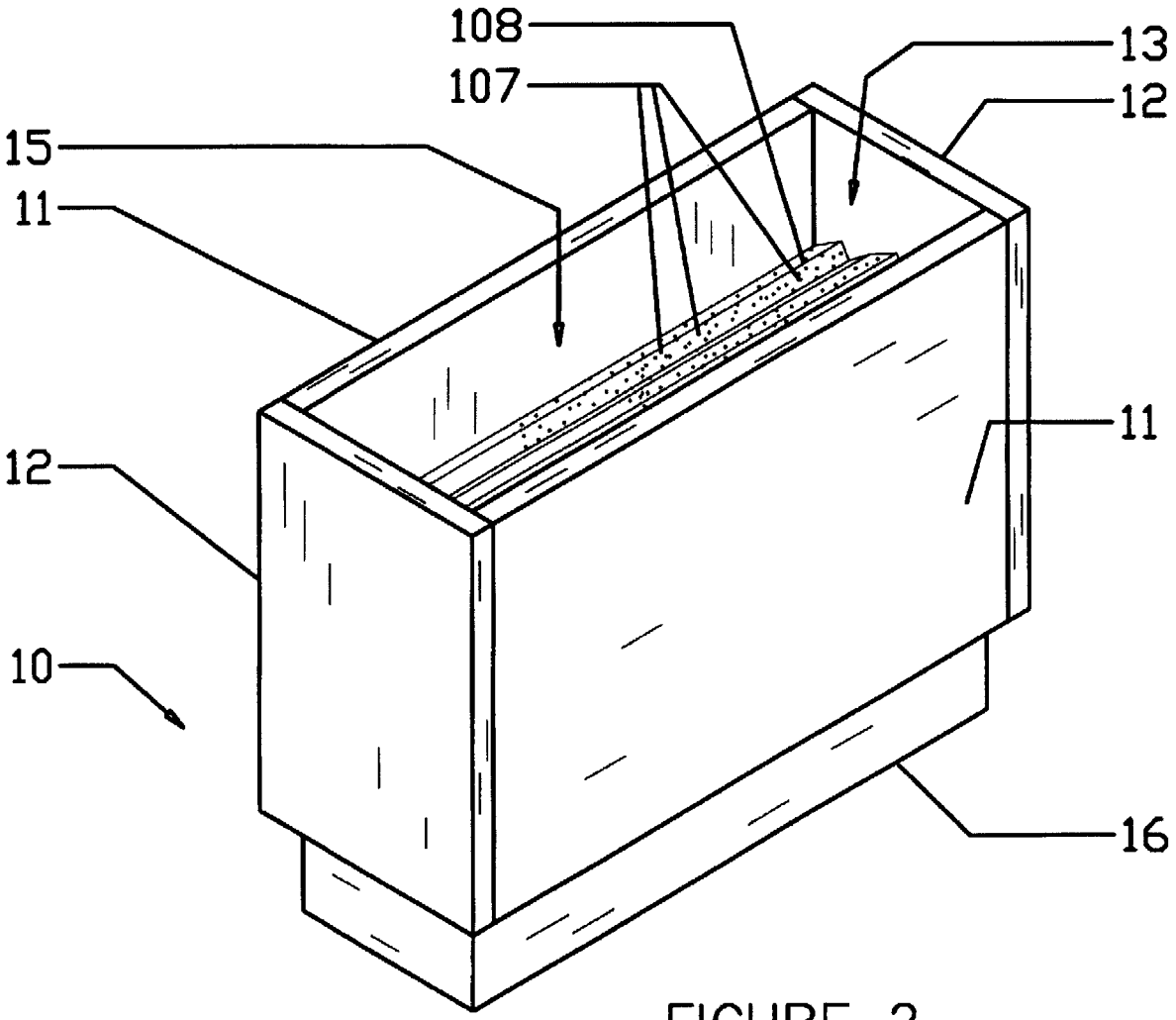
FIG. 2 is a perspective view of the single compartment embodiment of the shot retention chamber.
Figure 3:
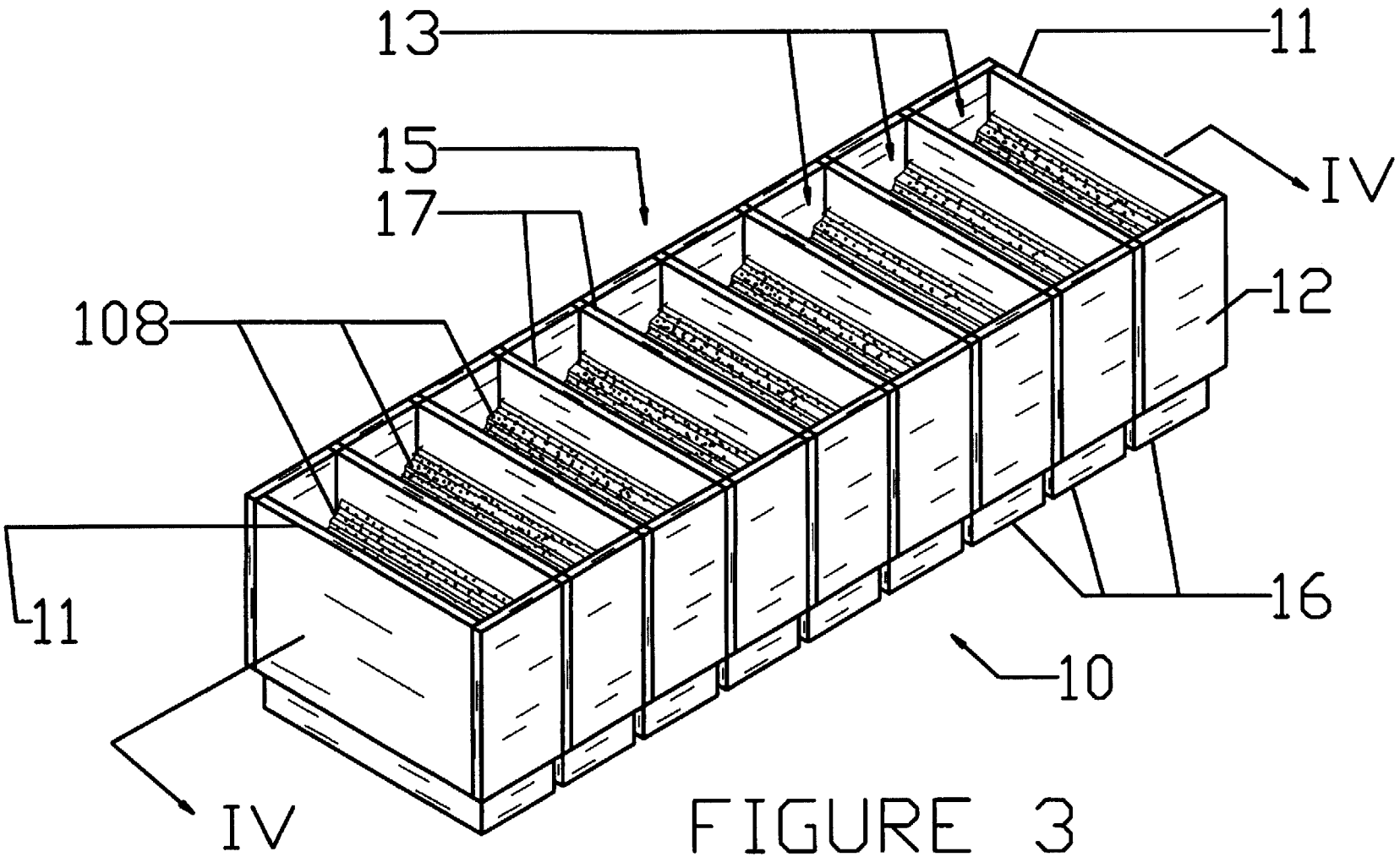
FIG. 3 is a perspective view of the multiple compartment embodiment of the shot retention chamber.

The invention comprises a shot retention chamber means 10, shown in a simple embodiment in FIG. 2 and a more preferred embodiment in FIG. 3. The shot retention chamber 10, as shown in FIG. 2, comprises two opposing side plates or walls 11 and two opposing end plates or walls 12, which are adjoined to form an interior compartment 13 in combination with a back plate or wall 14. The interior compartment 13 defines the retention area for a quantity of shot particles 107 which creates the impact absorbing shot layer 108. The shot retention chamber 10 has an open front face 15. Affixed to the external side of back wall 14 is shot retention means 16 to provide magnetic force through the back wall 14 and into the interior compartment 13. The magnetic shot retention means 16 may comprise any known means to provide magnetic force, and as shown is a bar magnet 16 presenting one polarity along the side contiguous with the back wall 14 and presenting the opposite polarity on the opposite side facing away from the back wall 14 and interior compartment 13. The required strength of the magnet 16 is a function of several factors, such as the particular shot 107 and the material composition and thicknesses of the various components of the shot retention chamber 10, but in general the stronger the magnet 16 the better. In a simple configuration as shown in FIG. 2, a magnet 16 identified as a ceramic 8 with a gauss rating of 3850 has proven to be of sufficient strength to retain the necessary shot layer 108. Other types of magnets 16, including electromagnets, could also be used.

The back wall 14 is composed of a non-magnetic material which does not interfere with the magnetic force, such as for example a sheet of manganese or stainless steel, and is preferably kept relatively thin for this same reason. The end walls 12 are also composed of non-magnetic material, such as manganese or stainless steel, and are designed to be of sufficient thickness to provide structural integrity to the shot retention chamber 10 as well as to provide a high strength surface capable of deflecting the high velocity shot 107 into the shot layer 108 without suffering overly rapid degradation of the material surface. The side walls 11 are composed of a hard, ferromagnetic material, such as case hardened steel or chrome molybdenum steel, in order to create the necessary magnetic field to retain the shot layer 108 and to withstand the impacts from the high velocity shot 107. In use, the shot chamber 10 is positioned in the shot stream 106 on the opposite side of the workpiece 102 across form the shot impeller 101. High velocity shot particles 107 which miss or are only slightly deflected by the workpiece 102 strike the shot layer 108. The shot layer 108 is maintained at sufficient depth, typically ½ inch or greater and dependent on the velocity and size of the thrown shot 107, to fully absorb the impact force of the shot 107, thus preventing the shot 107 from striking the back wall 14. The shot layer 108 is held in place by the magnetic force of magnet means 16, enabling the shot retention chamber 10 to be angled in any position from 0 to 90 degrees above or below the horizontal. The magnetic force is sufficient to retain the protective shot layer 108 even where the open front face 15 is directed below the horizontal. The magnetic force is also sufficient to capture some of the high velocity shot particles 107 to replace any individual shot particles 107 comprising shot layer 108 ejected from the interior compartment 13, such that a steady state protective shot layer 108 is maintained continually during operation of the shot blasting system 100.

Figure 4:
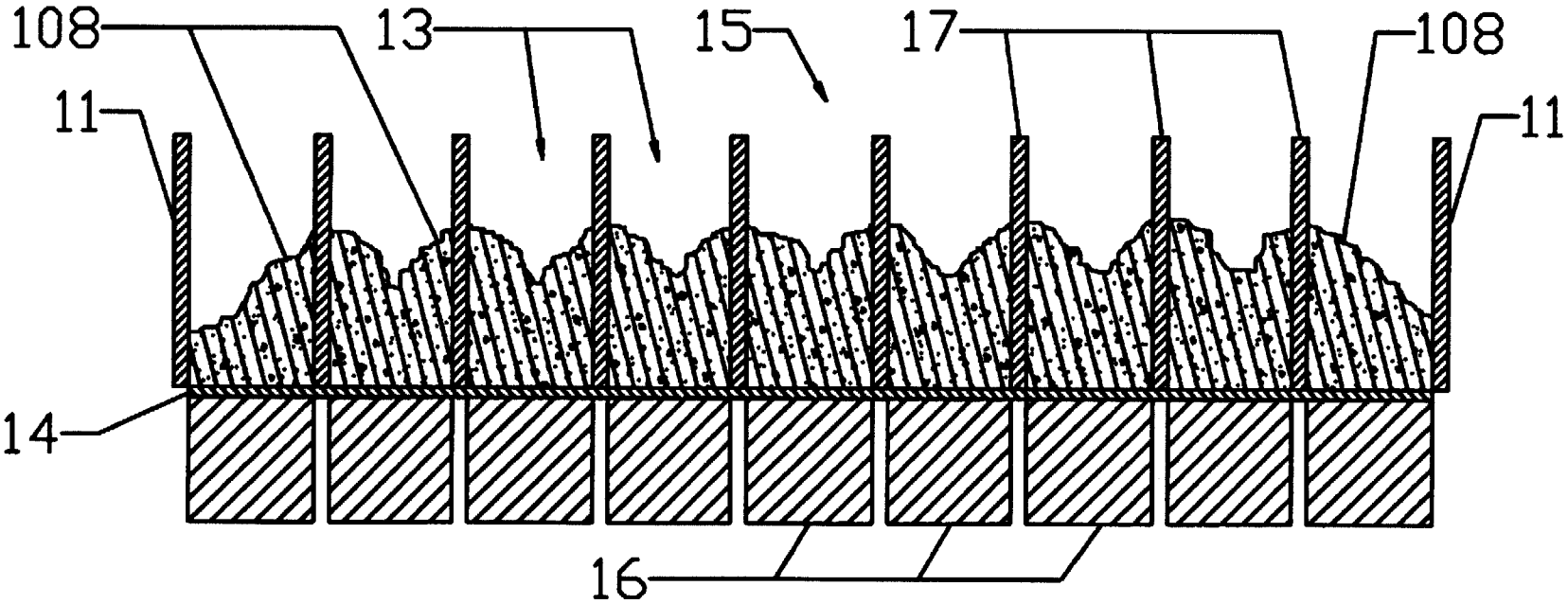
FIG. 4 is a cross-sectional view of the multiple compartment shot retention chamber showing a common distribution of the retained shot particles, the view taken along line IV—IV of FIG. 3.

The more preferred embodiment is illustrated in FIGS. 3 and 4. This embodiment comprises a shot retention chamber 10 having multiple interior compartments 13 defined by opposing side walls 11, opposing end walls 12, back wall 14 and divider plates or walls 17. In the illustrations, the ferromagnetic side walls 11 form the longitudinal walls of the two end compartments 13 and are parallel to the divider walls 17. The non-magnetic end walls 12 form the short latitudinal walls of the interior compartments 13, and the opposing end walls 12 may consist of multiple members connected laterally or may be elongated single member for each side. The divider walls 17 are composed of ferromagnetic material, such as case hardened or molybdenum steel, which has relatively high hardness in order to resist degradation from the impact of the high velocity shot particles 107. Each compartment 13 has a corresponding magnet means 16 contiguous to the back wall 14 and preferably co-extensive with the cross-section of the compartment 13. Dependent upon several variables, adjacent magnets 16 may be positioned such that the polarity presented to adjacent compartments 13 is the same or alternates. For the alternating configuration, for example, where the magnet 16 of one end compartment 13 is positioned with its north pole adjacent the back wall 14, the next magnet 16 will be positioned with its south pole adjacent the back wall 14, the next magnet 16 will be positioned with its north pole adjacent the back wall 14, and so forth. This creates a magnetic force field which shapes the shot layer 108 as shown in FIG. 4, whereby the thickest part of the shot layer 108 resides adjacent the magnetically saturated divider walls 17 and the thinnest part of the shot layer 108 resides at the midpoint between adjacent divider walls 17.

The divider walls 17 and multiple compartments 13 increase the effectiveness of the shot retention chamber 10 by preventing undesirable circulation of the shot 107 within the shot layer 108, which would be caused by the mainly uni-directional impact of the high velocity shot 107 from the impeller means 101. The wash-out effect of this uni-directional flow could eventually overcome the magnetic force and cause removal of more shot particles 107 than are replenished, or simply thin out particular areas of the shot layer 108 to expose the back wall 14 to the high velocity shot 107. The divider walls 17 deflect some shot particles 107 from the shot stream 106 and also deflect some ricochets and ejected shot 107 from the protective shot layer 108 in opposite direction to the main impacts, thus in effect collimating the shot stream 106 to cancel out the uni-directional impetus of the shot stream 106. The divider walls 17 can also be used to shape or extend the magnetic field to optimize distribution of the shot layer 108 within the chambers 13.

Although it is possible to adjust the height of the divider walls 17, side walls 11 and end walls 12 to only slightly exceed the maximum depth of the shot layer 108, it is preferred that the wall members extend a distance above the shot layer 108. For example, interior compartments 13 having a height of 4 inches, a length of 6 inches and a width of 2 inches have been shown to be suitable for use with a protective shot layer varying in thickness from approximately 0.75 to 2.5 inches. The extended walls 11, 12 and 17 help to entrap ricocheting shot particles 107.

Figure 7:
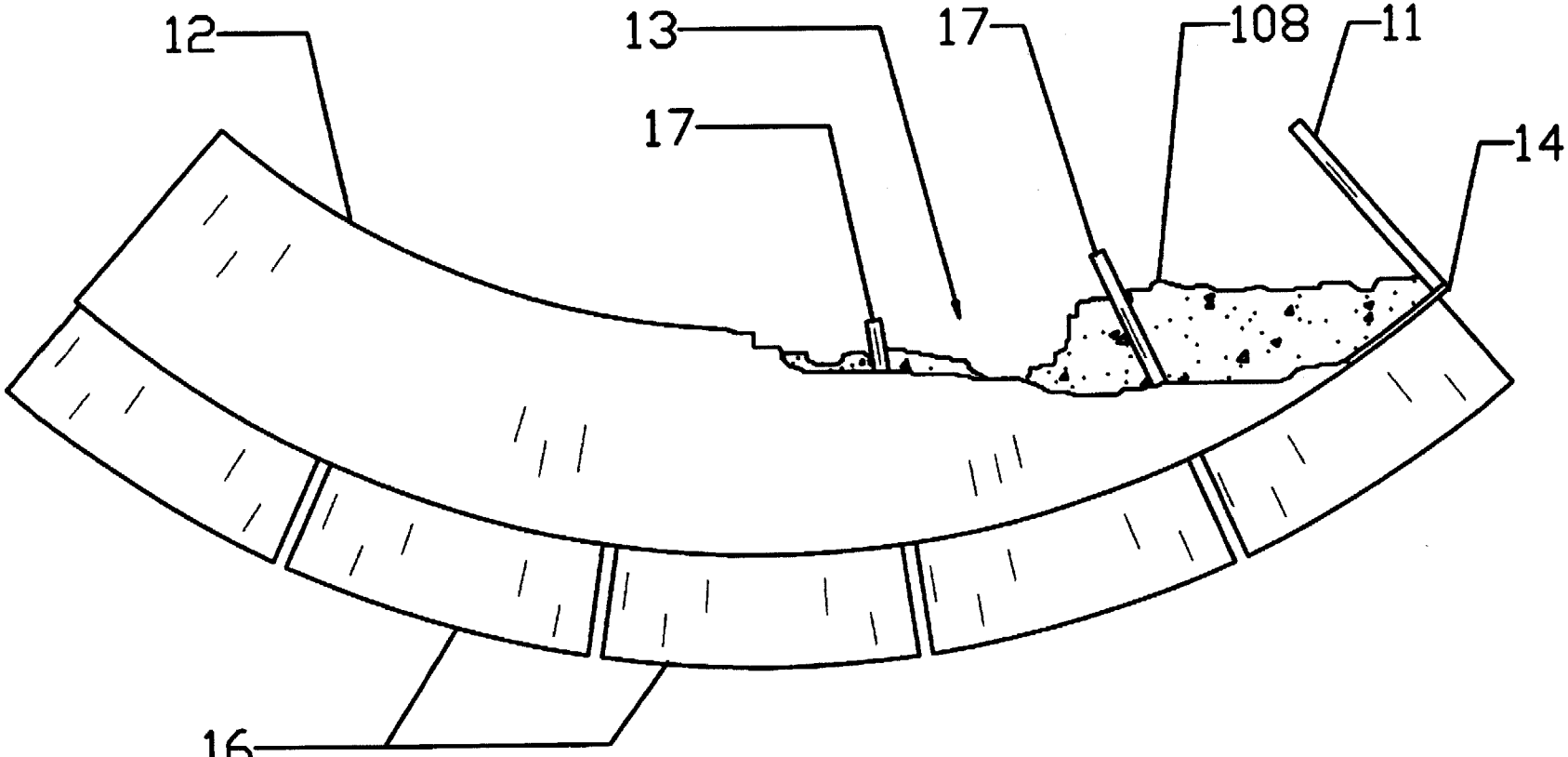
FIG. 7 is a partially exposed view of a curved embodiment of the shot retention chamber.
Figure 8:
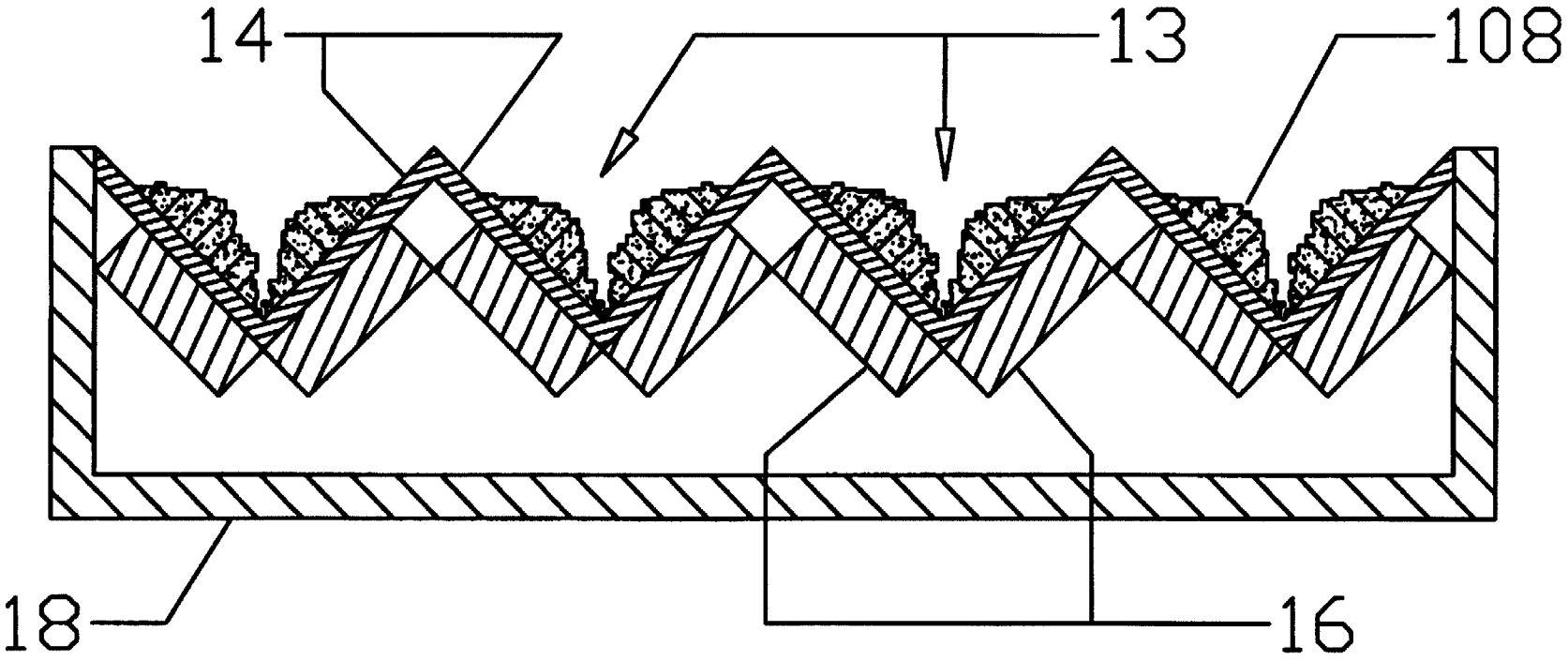
FIG. 8 is a cross-sectional view of the angled compartment embodiment of the shot retention chamber.

As shown in FIGS. 7 and 8, alternate embodiments for the shot retention chamber 10 are contemplated beyond the rectilinear configuration previously discussed. As shown in FIG. 7, the shot retention chamber 10 may be configured with a curved or arched back wall 14, which may serve to present the divider walls 17 in a more aligned manner relative to the shot impeller means 101 and shot stream 106. In a variation on this configuration, the back wall 14 could also be configured in a wide angled V-shape. As shown in FIG. 8, another embodiment for the shot retention chamber 10 alters the shape of the interior compartments 13 by configuring the back wall 14 as a series of angled segments rather than as a planar member, such that the pairing of adjacent back walls 14 form the interior compartments 13, and a separate backing member 18 spans the distance between the two side walls 11.

Figure 5:
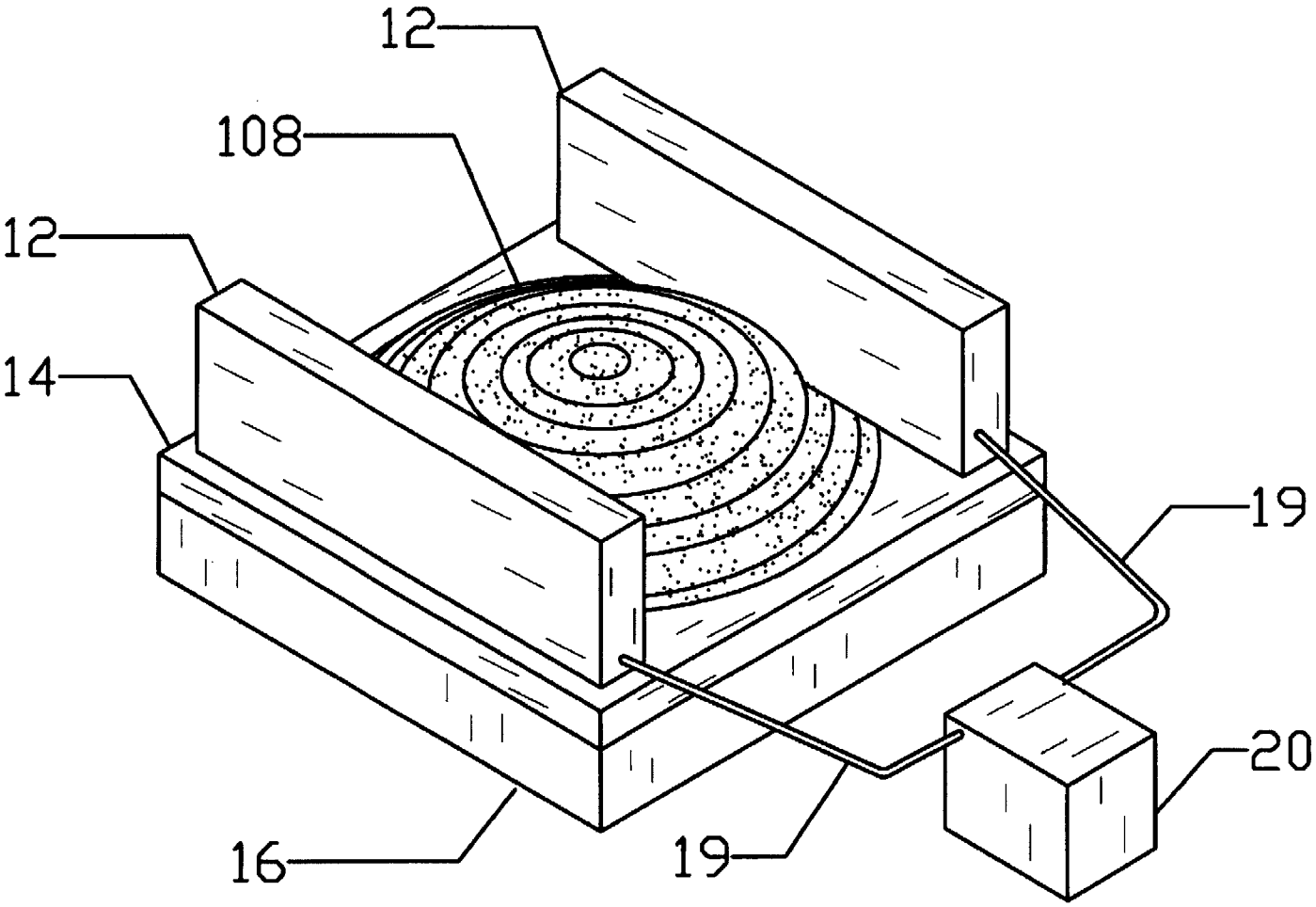
FIG. 5 is a perspective view of a single compartment electrically enhanced shot retention chamber.
Figure 6:
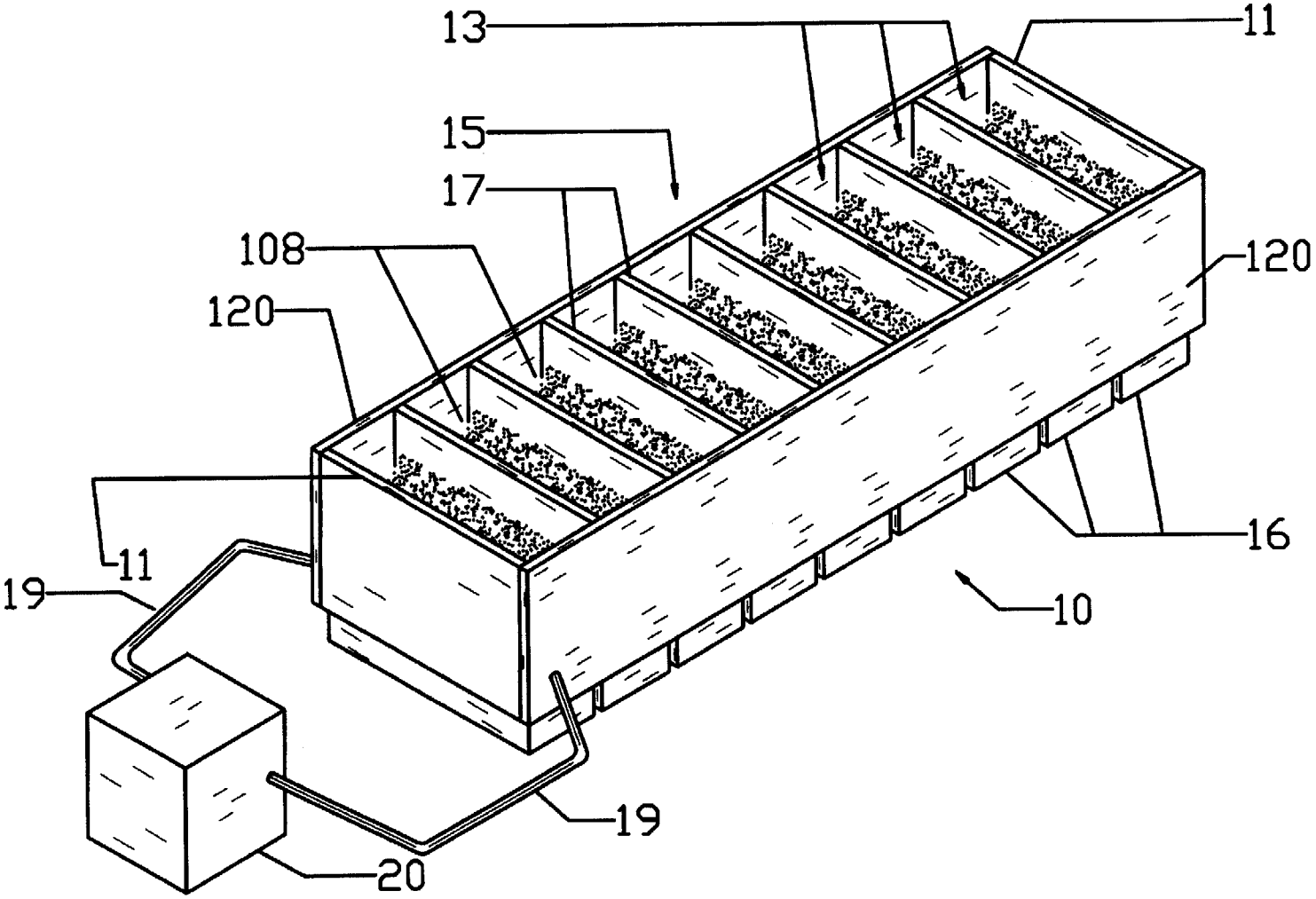
FIG. 6 is a perspective view of a multiple compartment electrically enhanced shot retention chamber.

Another alternative embodiment which is suitable for use with shot particles 107 which are merely electrically conductive, rather than ferromagnetic, is illustrated in FIGS. 5 and 6. This construction of the shot retention chamber utilizes magnetic means 16 mounted adjacent the back wall 14 to form a single compartment 13 or, preferably as shown in FIG. 6, in plural number with plural interior compartments 13 created by divider walls 17. In this embodiment the end walls 120 of each compartment 13 are formed of an electrically conductive material, and each end wall 120 is connected in circuit by electrical conduits 19 to an electrical supply source 20, shown representationally. The back wall 14, side walls 11 and the divider walls 17 are composed of materials not electrically conductive or these components are electrically insulated from contact with the end walls 120. In this manner, when an electrical current is applied to the circuit, the current flows from one electrode end wall 120, through the shot layer 108 of electrically conductive particles 107 and into the opposite electrode end wall 120. This electrical flow path, in concert with the magnetic force supplied by the magnets 16, entraps the electrically conductive shot particles 107 in the compartments 13 by a force described mathematically as the vector cross product of the electrical current and the magnetic field intensity, to form a protective shot layer 108 in the same manner as the magnets 16 alone entrap ferromagnetic shot particles 107. This embodiment would also be suitable for use with ferromagnetic shot particles 107, such that the same shot layer 108 depth may be maintained with magnets 16 of reduced strength.

It is contemplated that certain equivalents and substitutes for elements and components set forth above may be obvious to those skilled in the art. The true scope and definition of the invention, therefore, is not to be limited but is to be as set forth in the following claims.

I claim:

1. An impact shielding device for use in a shot blasting chamber to absorb the impact of high velocity shot particles impelled in a particle stream by a shot impeller device to prevent damage to the shot blasting chamber, the impact shielding device comprising a shot retention chamber defining an interior compartment and which is mountable within said shot blasting chamber at any angle up to 90 degrees above or below horizontal so as to receive high velocity shot particles impelled in a particle stream by a shot impeller device, said shot retention chamber having shot retention means to retain a layer of shot particles within said interior compartment of said shot retention chamber, whereby said layer of shot absorbs the impact of said high velocity shot particles.

2. The device of claim 1, where said means to retain said layer of shot within said shot retention chamber comprise magnetic means.

3. The device of claim 1, where said shot retention chamber comprises multiple interior compartments, said shot retaining means retaining a layer of shot particles within each said interior compartment.

4. The device of claim 1, where said shot retention chamber comprises two opposing end walls, two opposing side walls and a back wall.

5. The device of claim 4, further comprising divider walls to create interior compartments within said shot retention chamber.

6. The device of claim 5, where said shot retention means comprises magnets, each said interior compartment having a corresponding magnet mounted behind said back wall.

7. The device of claim 6, where said side walls and said divider walls are composed of a ferromagnetic material and said end walls are composed of a non-ferromagnetic material.

8. The device of claim 7, where said magnets are mounted such that adjacent magnets have the same polarity facing said back wall.

9. The device of claim 7, where said magnets are mounted such that adjacent magnets have opposite polarities facing said back wall.

10. The device of claim 7, where said back wall is curved.

11. The device of claim 1, where said shot retention means comprises a combination of magnetic means mounted adjacent said interior compartment of said shot retention chamber and electrical means passing an electrical current through said layer of shot.

12. The device of claim 11, where said shot retention chamber comprises a back wall and two end walls, where said magnetic means is mounted behind said back wall and said electrical means comprises electrical conduits and an electrical supply source connected to said end walls, such that an electrical current is passed through said end walls and said layer of shot.

13. The device of claim 12, further comprising two electrically non-conductive side walls and electrically non-conductive divider walls creating multiple interior compartments within said shot retention chamber.

14. The device of claim 1, where said shot retention chamber further comprises a back wall configured as a series of angled segments, where said shot retention means comprises magnets mounted behind said back wall.

* * * * *